United States Patent [19]

Bullock

[11] Patent Number: 4,599,833

[45] Date of Patent: Jul. 15, 1986

[54] INSERT RETAINER FOR STORM DOOR

[75] Inventor: Robert E. Bullock, Malvern, Ark.

[73] Assignee: Chamberlain Manufacturing Corporation, Elmhurst, Ill.

[21] Appl. No.: 617,513

[22] Filed: Jun. 5, 1984

[51] Int. Cl.[4] ..... E04B 1/40

[52] U.S. Cl. ..... 52/127.5; 52/397

[58] Field of Search ..... 52/127.5, 397, 398

[56] References Cited

U.S. PATENT DOCUMENTS

| | | | |
|---|---|---|---|
| 2,268,269 | 12/1941 | Toney et al. | 52/398 |
| 3,016,993 | 1/1962 | Owen | 52/398 |
| 3,090,085 | 5/1963 | Brown | 52/397 |
| 3,203,053 | 8/1965 | Lane et al. | 52/398 |
| 3,212,225 | 10/1965 | Neal | 52/397 |
| 4,067,152 | 1/1978 | Wolma | 52/127.5 |
| 4,156,988 | 6/1979 | Grover et al. | 52/397 |

FOREIGN PATENT DOCUMENTS

| | | | |
|---|---|---|---|
| 7605139 | 11/1977 | Netherlands | 52/397 |
| 1222145 | 6/1968 | United Kingdom | 52/397 |

*Primary Examiner*—John E. Murtagh
*Assistant Examiner*—C. Dennison
*Attorney, Agent, or Firm*—Hill, Van Santen, Steadman & Simpson

[57] ABSTRACT

An insert retainer for securing a door insert such as a window or screen unit within the door frame and comprising a one-piece flexible strip having a generally flat first web portion, a second web portion which extends from one end of the first web portion perpendicular thereto, a third web portion forming a channel with the first and second web portions, an arcuate integral hinge forming an extension of the second web portion, and an end portion extending outwardly from the integral hinge at an acute angle to the second web portion. The angularly extending end portion is arranged to be tightly received within a channel formed in the storm door and thereby compress the integral hinge about a bead forming a part of the channel construction. The invention also deals with an improved storm door including the new insert retainer.

2 Claims, 6 Drawing Figures

INSERT RETAINER FOR STORM DOOR

BACKGROUND OF THE INVENTION

1. Field of the Invention

This invention is in the field of insert retainers for securing a door insert within a frame and is characterized by a one-piece flexible strip which has a generally channel-like configuration so that it can be snapped into position within a suitable channel in the door frame structure to tightly and sealingly retain the door insert within the frame.

2. Description of the Prior Art

In typical combination storm doors utilizing a window for winter and a screen insert for summer, the window or screen is locked mechanically into the door frame opening by means of angular lugs and sheet metal screws. While this provides an effective mechanical lock, it does not prevent moisture penetration nor does it provide an effective thermal barrier. As a result the storm door, particularly during winter, is not as weatherproof as would be desired.

SUMMARY OF THE INVENTION

The present invention provides an insert retainer for securing a door insert within a door frame. The insert retainer includes a one-piece flexible strip which has a generally flat first web portion, a second web portion extending from one end of the first web portion at a right angle thereto, with an arcuate integral hinge forming an extension of the second web portion. The terminal portion of the strip beyond the arcuate integral hinge is an end portion which extends from the hinge at an acute angle to the second web portion. The strip is arranged to be received within a channel in the door frame, the end portion being tightly received within the channel and causing the arcuate hinge to be compressed against a bead which forms part of the cross section of channel in the door frame.

In a preferred form of the invention, the second web portion has a groove therein between the integral hinge and the first web portion, the groove being of sufficient dimensions to accommodate a screwdriver blade for disengaging the retainer when engaged in the channel of the door frame. Finger grip portions can also be provided on the underside of the web portion located between the integral hinge and the adjoining web portion. The retainer also includes a third web portion which is parallel to the second web portion, the three web portions functioning to form an open-ended channel.

BRIEF DESCRIPTION OF THE DRAWINGS

A further description of the present invention will be made in conjunction with the attached sheets of drawings, in which.

DESCRIPTION OF THE PREFERRED EMBODIMENTS

Figure 1:
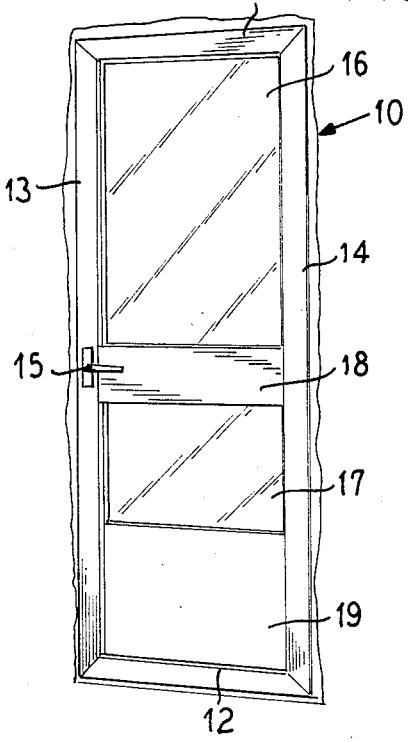
FIG. 1 is a view in elevation of a storm door assembly of the type to which the present invention may be applied.

In FIG. 1, reference numeral 10 indicates generally a combination storm door of the type to which the present invention is applicable. The door 10 includes a top rail 11 and a bottom rail 12 together with vertically extending stiles 13 and 14. A latch 15 is provided to latch the door to the door jamb.

The storm door may include a pair of window units, including an upper light 16 and a lower light 17 separated by a crosspiece 18. A kick plate 19 is positioned between the bottom rail 12 and the lower window light 17.

Figure 2:
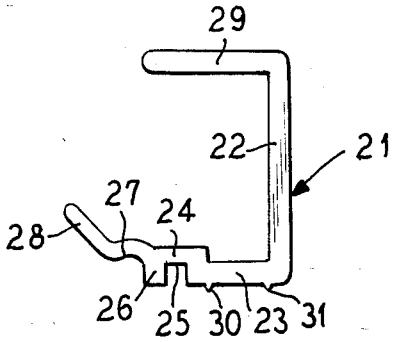
FIG. 2 is a plan view of an improved insert retainer according to the present invention in its free, uncompressed form.
Figure 3:
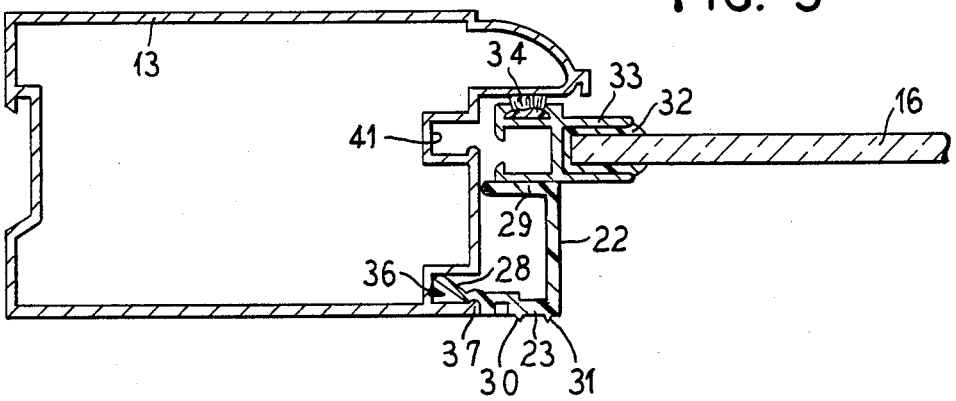
FIG. 3 illustrates the manner in which the retainer of FIG. 2 is received within a door frame.

A preferred type of insert retainer for use in the present invention is illustrated in FIG. 2 by itself and in its operative position in FIG. 3. There is illustrated a one-piece retainer 21 composed of a flexible plastic material such as a vinyl plastic and including a relatively flat web portion 22. At its lower end the web portion 22 meets with a second web portion 23, the second web portion 23 being perpendicular to the web portion 22. The second web portion 23 has a thickened offset portion as illustrated at reference numeral 24 and, in the offset portion, there is provided a groove 25 which can be used to facilitate removal of the retainer strip from the door frame, as will be explained in a succeeding portion of this Specification. Immediately outwardly of the groove 25 is a projection 26. An arcute integral hinge 27 serves to connect a terminal end portion 28 to the remainder of the strip, the terminal end portion 28 in its free condition extending at an obtuse angle of about 135° to the plane of the web portion 23.

There is a third web portion 29 generally parallel to the web portion 23 and together with the other web portions 22 and 23 serves to define a channel-shaped member.

Finger grip portions 30 and 31 on the underside of the web portion 23 may be provided for gripping.

The manner in which the insert retainer of FIG. 2 can be used in conjunction with the storm door is shown in FIG. 3. The particular insert is the glass light 16 which has a cushioning seal 32 around its periphery, the perimeter of the window being received within a metallic channel strip 33. A piece of felt 34 or similar material is attached to the channel strip 33 to serve as a thermal insulating material and to prevent metal-to-metal contact between the door frame and the strip.

Figure 5:
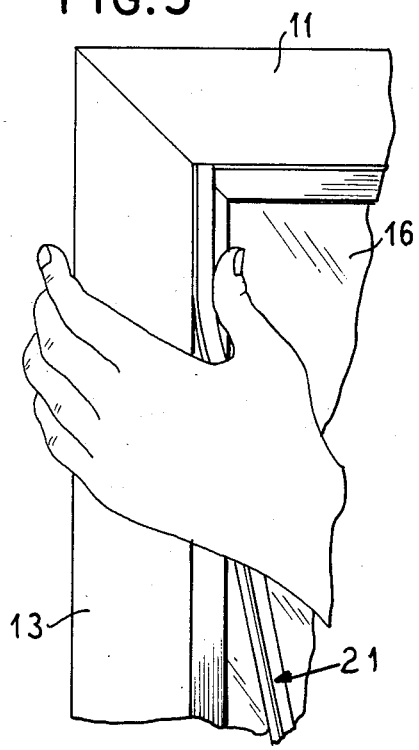
FIG. 5 is a fragmentary view showing the manner in which the improved insert retainer of the present invention can be snapped in position within the door frame.

The stile 13 has a channel 36 formed therein including an inwardly facing bead 37. As shown in FIG. 5, the insert retainer strip 21 can be easily engaged with the channel 36 by wedging the end portion 28 diagonally into the channel in tightly fitting relation. This compresses the arcuate integral hinge 27 about the bead 37 as shown in FIG. 3 so that there is a tightfitting, effectively sealed relation provided between the insert and the door frame.

Figure 6:
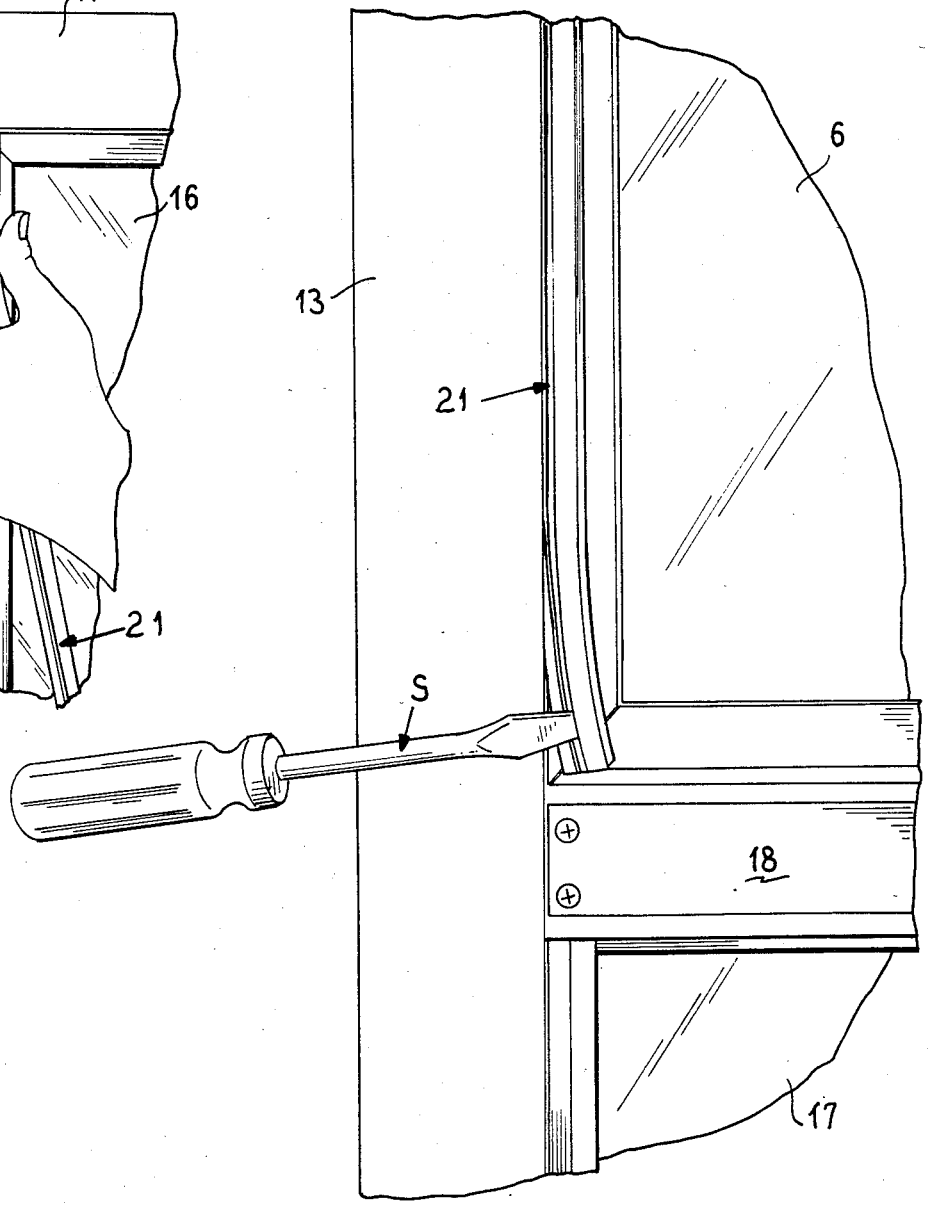
FIG. 6 is a fragmentary view in elevation showing one manner in which the insert retainer can be easily disengaged from the door frame.

Removal of the strip as shown in FIG. 6 is also readily accomplished. Such removal only requires a tool such as a screwdriver S whose blade is received within the groove 25 to dislodge the strip 21 from the channel 36. In fact, inserting a coin or the like within the groove is usually effective to disengage the strip 21 from the frame.

Figure 4:
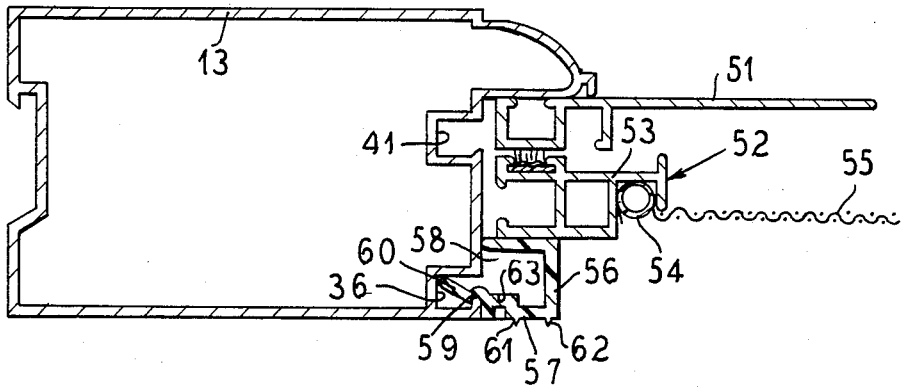
FIG. 4 is a cross-sectional view of another form of the invention as applied to retaining a window screen within the door frame.

The form of the invention shown in FIG. 4 illustrates that the insert strip of the present invention, with proper proportioning, can be used to hold several inserts in the door frame in stacked relationship. The particular arrangement shown in FIG. 4 includes a decorative strip 51 and a window screen assembly generally illustrated at reference numeral 52. The window screen assembly includes a frame 53 having a channel portion which receives a compressible tube 54 which acts as a sealing means between a window screen 55 and the frame 53. The insert retainer includes a relatively short web portion 56 which at its bottom end is connected to a second web portion 57 and at its top is connected to another web portion 58 to form a channel. As in the previous embodiments, the insert retainer has an arcuate integral hinge 59 and an angularly extending end portion 60 which is tightly received in the channel 36. Finger grips 61 and 62 are provided on the underside of the web 57, and a groove 63 located adjacent the integral hinge 59 provides a means for inserting a screwdriver blade or the like to disengage the strip from the door frame as illustrated in FIG 6.

It will be seen that the insert retainer of the present invention provides a convenient and effective means for locating inserts within a storm door frame. The insert retainer can be simply applied about the perimeter of the insert without any tools being required, since the geometry is such that the retainer can be snapped into the appropriate channel and its natural resilience serves to hold it in place.

It should be evident that various modifications can be made to the described embodiments without departing from the scope of the present invention.

I claim as my invention:

1. A storm door assembly, having an inner side, comprising:

a frame having vertical and horizontal frame members defining an opening, said vertical frame members each having a vertically extending rectangular channel extending therealong formed with an inwardly facing bead, a window structure, having an interior, proportioned to be received in said opening, and an insert retainer for securing said window structure within said frame members in readily releasable engagement, said retainer comprising:

a one-piece flexible peel-out type strip composed of a resiliently compressible resinous material and having a generally flat first web portion, a second web portion, having an underside and a bottom, extending from one end of said first web portion at a right angle thereto, a third web portion parallel to said second web portion, said three web portions forming an open-ended channel, an arcuate integral hinge forming an extension of said second web portion, said hinge engaging said inwardly facing bead, and an end portion extending outwardly from said integral hinge at an obtuse angle to said second web portion, said end portion being wedged diagonally into said channel in tightly fitting relation, thereby compressing said hinge securely about said bead, said strip having a groove therein parallel to said integral hinge and located in said second web portion parallel to said third web portion, said groove being accessible from the interior of said window when said window is received in said frame permitting release from said channel by insertion therein of a screwdriver or the like, said strip having sufficient inherent flexibility to be snapped into said channel where it is held by its natural resiliency.

2. A storm door assembly according to claim 1 wherein:

said retainer includes finger grip portions on the underside of said second web portion located at the bottom thereof facing away from said third web portion and freely accessible from the inner side of said storm door, said portions being located between said integral hinge and said first web portion.

* * * * *